US009607550B2

(12) United States Patent
Sugimoto et al.

(10) Patent No.: US 9,607,550 B2
(45) Date of Patent: Mar. 28, 2017

(54) SCANNING LINE DRIVING DEVICE, DISPLAY APPARATUS AND SCANNING LINE DRIVING METHOD

(71) Applicant: FUTABA CORPORATION, Mobara-shi, Chiba-ken (JP)

(72) Inventors: Terukazu Sugimoto, Mobara (JP); Keisuke Kawana, Mobara (JP)

(73) Assignee: FUTABA CORPORATION, Mobara-Shi, Chiba-Ken (JP)

( * ) Notice: Subject to any disclaimer, the term of this patent is extended or adjusted under 35 U.S.C. 154(b) by 0 days.

(21) Appl. No.: 14/568,183

(22) Filed: Dec. 12, 2014

(65) Prior Publication Data

US 2015/0170573 A1 Jun. 18, 2015

(30) Foreign Application Priority Data

Dec. 17, 2013 (JP) ..... 2013-260485

(51) Int. Cl.

| | |
|---|---|
| ***G09G 3/30*** | (2006.01) |
| ***G09G 3/3266*** | (2016.01) |
| *G09G 3/10* | (2006.01) |
| *G09G 3/3216* | (2016.01) |

(52) U.S. Cl.

CPC ..... *G09G 3/3266* (2013.01); *G09G 3/3216* (2013.01); *G09G 2310/062* (2013.01); *G09G 2320/0233* (2013.01)

(58) Field of Classification Search

CPC ..... G06G 3/3216; G09G 3/3266
USPC ..... 345/76, 78; 315/169.3
See application file for complete search history.

(56) References Cited

U.S. PATENT DOCUMENTS

| | | | | |
|---|---|---|---|---|
| 6,201,520 | B1 * | 3/2001 | Iketsu | G09G 3/3216 345/76 |
| 6,351,076 | B1 * | 2/2002 | Yoshida | G09G 3/3216 345/77 |
| 6,369,515 | B1 * | 4/2002 | Okuda | G09G 3/3216 345/76 |
| 6,369,516 | B1 * | 4/2002 | Iketsu | G09G 3/3216 345/76 |
| 6,587,087 | B1 * | 7/2003 | Ishizuka | G09G 3/3216 345/77 |
| 2002/0033782 | A1 * | 3/2002 | Ogusu | G09G 3/3216 345/76 |

(Continued)

OTHER PUBLICATIONS

Taiwanese Office Action dated Feb. 2, 2016, including search report, issued in corresponding Taiwanese Patent Application No. 103143830 and English translation thereof.

*Primary Examiner* — Adam J Snyder
(74) *Attorney, Agent, or Firm* — Bacon & Thomas, PLLC

(57) ABSTRACT

A scanning line driving device drives scanning lines in a display unit including data lines each connected to a plurality of pixels arranged in a column direction and the scanning lines each connected to a plurality of pixels arranged in a row direction, the pixels arranged at respective intersections of the data lines and the scanning lines. The device is configured to sequentially keep each of the scanning lines in a selected state pursuant to a predetermined order and output a scanning line drive signal, which is set to a low level in a high-luminance display drive and to a high level in a low-luminance display drive, to all the scanning lines during a blanking period between a period in which one scanning line is kept selected and a period in which a next scanning line is kept selected.

8 Claims, 11 Drawing Sheets

(56) References Cited

U.S. PATENT DOCUMENTS

| | | | | |
|---|---|---|---|---|
| 2002/0101169 | A1* | 8/2002 | Boer | G09G 3/3216 315/169.3 |
| 2003/0043127 | A1* | 3/2003 | Satoh | G09G 3/3216 345/204 |
| 2004/0080472 | A1* | 4/2004 | Miyakawa | G09G 3/3216 345/76 |
| 2006/0022911 | A1* | 2/2006 | Satoh | G09G 3/3216 345/76 |
| 2007/0120778 | A1* | 5/2007 | Kimura | G09G 3/3216 345/76 |
| 2008/0266277 | A1* | 10/2008 | Ichikura | G09G 3/3216 345/205 |
| 2008/0272989 | A1* | 11/2008 | Takahashi | G09G 3/3216 345/76 |

* cited by examiner

| BK | OUT |
|---|---|
| 0 | Q OUTPUT |
| 1 | LBK |

*FIG. 7A*

LUMINANCE LEVEL = 100

[μs]

| GRADATION VALUE | PULSE WIDTH |
|---|---|
| 1/15 | 3.5 |
| 2/15 | 4.5 |
| 3/15 | 6.5 |
| 4/15 | 8.5 |
| 5/15 | 11.5 |
| 6/15 | 15.5 |
| 7/15 | 28.5 |
| 8/15 | 35.5 |
| 9/15 | 44.0 |
| 10/15 | 55.0 |
| 11/15 | 68.5 |
| 12/15 | 84.5 |
| 13/15 | 102.5 |
| 14/15 | 123.0 |
| 15/15 | 145.0 |

LUMINANCE LEVEL = 60

[μs]

| GRADATION VALUE | PULSE WIDTH |
|---|---|
| 1/15 | 2.5 |
| 2/15 | 3.5 |
| 3/15 | 5.0 |
| 4/15 | 6.5 |
| 5/15 | 8.5 |
| 6/15 | 11.0 |
| 7/15 | 13.5 |
| 8/15 | 17.0 |
| 9/15 | 25.5 |
| 10/15 | 31.0 |
| 11/15 | 37.5 |
| 12/15 | 45.5 |
| 13/15 | 55.0 |
| 14/15 | 66.0 |
| 15/15 | 78.5 |

*FIG. 8*

LUMINANCE LEVEL = 100

[μs]

| GRADATION VALUE | PULSE WIDTH |
|---|---|
| 1/15 | 3.5 |
| 2/15 | 4.5 |
| 3/15 | 6.5 |
| 4/15 | 8.5 |
| 5/15 | 11.5 |
| 6/15 | 15.5 |
| 7/15 | 28.5 |
| 8/15 | 35.5 |
| 9/15 | 44.0 |
| 10/15 | 55.0 |
| 11/15 | 68.5 |
| 12/15 | 84.5 |
| 13/15 | 102.5 |
| 14/15 | 123.0 |
| 15/15 | 145.0 |

LUMINANCE LEVEL = 50

[μs]

| GRADATION VALUE | PULSE WIDTH |
|---|---|
| 1/15 | 2.5 |
| 2/15 | 3.5 |
| 3/15 | 4.5 |
| 4/15 | 6.0 |
| 5/15 | 8.0 |
| 6/15 | 10.0 |
| 7/15 | 12.0 |
| 8/15 | 15.0 |
| 9/15 | 18.5 |
| 10/15 | 27.0 |
| 11/15 | 32.0 |
| 12/15 | 38.5 |
| 13/15 | 46.0 |
| 14/15 | 55.5 |
| 15/15 | 65.0 |

L BLANKING DRIVE

SWITCHING

LUMINANCE LEVEL = 49

[μs]

| GRADATION VALUE | PULSE WIDTH |
|---|---|
| 1/15 | 11.0 |
| 2/15 | 15.0 |
| 3/15 | 19.0 |
| 4/15 | 25.5 |
| 5/15 | 32.5 |
| 6/15 | 38.0 |
| 7/15 | 43.5 |
| 8/15 | 50.5 |
| 9/15 | 57.5 |
| 10/15 | 65.5 |
| 11/15 | 73.5 |
| 12/15 | 83.0 |
| 13/15 | 92.0 |
| 14/15 | 102.5 |
| 15/15 | 113.0 |

LUMINANCE LEVEL = 3

[μs]

| GRADATION VALUE | PULSE WIDTH |
|---|---|
| 1/15 | 6.5 |
| 2/15 | 7.5 |
| 3/15 | 8.5 |
| 4/15 | 10.0 |
| 5/15 | 11.5 |
| 6/15 | 13.0 |
| 7/15 | 14.5 |
| 8/15 | 16.5 |
| 9/15 | 18.0 |
| 10/15 | 20.0 |
| 11/15 | 21.5 |
| 12/15 | 23.5 |
| 13/15 | 25.0 |
| 14/15 | 26.5 |
| 15/15 | 28.0 |

H BLANKING DRIVE

SCANNING LINE DRIVING DEVICE, DISPLAY APPARATUS AND SCANNING LINE DRIVING METHOD

CROSS-REFERENCE TO RELATED APPLICATION

This application claims priority to Japanese Patent Application No. 2013-260485 filed on Dec. 17, 2013, the entire contents of which are incorporated herein by reference.

FIELD OF THE INVENTION

The present invention relates to a scanning line driving device, a display apparatus and a scanning line driving method. More particularly, the present invention relates to a technology for driving a display unit in which pixels are arranged at intersections of data lines and scanning lines.

BACKGROUND OF THE INVENTION

As display panels for displaying an image, there are known a display apparatus that makes use of an OLED (Organic Light Emitting Diode) and a display apparatus that makes use of an LCD (Liquid Crystal Display). Many display apparatuses include a display unit in which data lines each connected to a plurality of pixels arranged in a column direction and scanning lines each connected to a plurality of pixels arranged in a row direction are disposed and in which the pixels are arranged at intersections of the data lines and the scanning lines.

In the case of so-called line sequential scanning, a scanning line driving unit sequentially selects scanning lines in response to a scanning line driving signal, and a data line driving unit outputs a data line drive signal (a gradation signal) for one scanning line to the respective data lines, whereby the display of each dot, i.e., pixel, is controlled.

Japanese Patent Application Publication No. H9-232074 discloses a technology in which, in order to improve the delay in the rise of pixel light emission attributable to the parasitic capacitance of a display panel, all scanning lines are connected to a reset potential during a blanking period occurring when the selected state of a scanning line is shifted to the next scanning line.

Japanese Patent Application Publication 2003-288053 discloses a technology in which a reverse bias voltage of a light emitting element is lowered during the dimmer control (also called "dimming") that the entire display is set at low luminance.

Japanese Patent Application Publication H11-45071 discloses a technology in which all scanning lines are set at an H-level potential during a blanking period occurring when the selected state of a scanning line is shifted to the next scanning line.

In the case of a passively-driven OLED display apparatus, e.g., a vehicle-mounted display apparatus, it is required to switch high-luminance display drive and low-luminance display drive depending on the brightness of the surroundings.

For example, during the daytime, high-luminance display (e.g., normal luminance display) is performed in order to ensure visibility. However, during the nighttime, dimming (low-luminance display) is performed because normal luminance is too high in the nighttime.

If the entire luminance is lowered to some extent by virtue of the dimming, there is sometimes the case that the gradation collapse occurs and the display quality decreases.

SUMMARY OF THE INVENTION

In view of the above, the present invention provides a scanning line driving device, a display apparatus and a scanning line driving method, which are capable of maintaining gradations even under a low-luminance display drive state, when display drive for switching high-luminance display drive and low-luminance display drive is performed.

In accordance with a first aspect of the present invention, there is provided a scanning line driving device for driving scanning lines in a display unit which includes data lines each connected to a plurality of pixels arranged in a column direction and the scanning lines each connected to a plurality of pixels arranged in a row direction, the pixels arranged at respective intersections of the data lines and the scanning lines, wherein the device is configured to sequentially keep each of the scanning lines in a selected state pursuant to a predetermined order and output a scanning line drive signal, which is set to a low level in a high-luminance display drive and to a high level in a low-luminance display drive, to all the scanning lines during a blanking period between a period in which one scanning line is kept selected and a period in which a next scanning line is kept selected.

By setting all the scanning lines at an L level during the blanking period, it is possible to improve the rise of the data line drive signal. However, if the supply time of the data line drive signal is shortened due to the low-luminance display drive, gradation collapse may occur. Therefore, in the low-luminance display drive, all the scanning lines are set to an H level during the blanking period.

Further, the scanning line driving device may include: a signal generating unit configured to generate a signal for each of the scanning lines, the signal indicating whether a corresponding scanning line among the scanning lines is in a selected state or in a non-selected state; a plurality of selectors provided to respectively correspond to the scanning lines, wherein each of the selectors receives the signal sent from the signal generating unit for the corresponding scanning line and a blanking level signal of a high level or a low level, and outputs, based on a blanking control signal which defines the blanking period, the signal sent from the signal generating unit during a non-blanking period and the blanking level signal during the blanking period; and an output unit configured to output, as the scanning line drive signal for each of the scanning lines, a voltage signal corresponding to an output of each of the selectors, wherein the blanking level signal inputted to each of the selectors is set to a low level in the high-luminance display drive and to a high level in the low-luminance display drive.

According to this configuration, it is possible to output the scanning line drive signal which sets all the scanning lines to an L level in the high-luminance display drive and an H level in the low-luminance display drive, during the blanking period.

In accordance with a second aspect of the present invention, there is provided a display apparatus including: a display unit including data lines each connected to a plurality of pixels arranged in a column direction and scanning lines each connected to a plurality of pixels arranged in a row direction, the pixels arranged at respective intersections of the data lines and the scanning lines; a scanning line driving unit configured to apply a scanning line drive signal to each of the scanning lines; and a data line driving unit configured to apply a data line drive signal to each of the data lines, the data line drive signal corresponding to a gradation value of each of the pixels defined by display data. The scanning line driving unit is configured to sequentially keep each of the scanning lines in a selected state pursuant to a predetermined order and output a scanning line drive signal, which is set to a low level in a high-luminance display drive and to a high level in a low-luminance display drive, to all the scanning lines during a blanking period between a period in which one scanning line is kept selected and a period in which a next scanning line is kept selected.

That is to say, the display apparatus is provided with the aforementioned scanning line driving device as a scanning line driving unit.

Further, the display apparatus may further include a drive control unit configured to receive instruction information on a display operation from the outside, and wherein when receiving, as the instruction information, blanking level designation information and a gradation setting table corresponding to a display luminance, the drive control unit may control the data line drive signal of the data line driving unit to be generated based on the gradation setting table, and may supply, to the scanning line driving unit, a blanking level signal of a high level or a low level corresponding to the blanking level designation information, and wherein the scanning line driving unit may output, as the scanning line drive signal for each of the scanning lines, a voltage signal corresponding to the blanking level signal, during the blanking period.

The drive control unit receives instruction information (e.g., a command on a display operation) from the outside (e.g., an external control device). The high-luminance display drive or the low-luminance display drive is instructed in response to the instruction information. The luminance of the display unit is controlled by acquiring the gradation setting table as the instruction information and by driving the data lines with the data line driving unit based on the gradation setting table. At this time, the blanking level designation information is also acquired, and in response to this, the drive control unit supplies the blanking level signal to the scanning line driving unit. By selecting the supplied blanking level signal during the blanking period, the scanning line driving unit can switch, during the blanking period, the signal level of the scanning line drive signal to an L level in the high-luminance display drive and an H level in the low-luminance display drive.

In accordance with a third aspect of the present invention, there is provided a scanning line driving method for driving scanning lines in a display unit which includes data lines each connected to a plurality of pixels arranged in a column direction and the scanning lines each connected to a plurality of pixels arranged in a row direction, the pixels arranged at respective intersections of the data lines and the scanning lines, wherein each of the scanning lines is sequentially kept in a selected state pursuant to a predetermined order, and a scanning line drive signal, which is set to a low level in a high-luminance display drive and to a high level in a low-luminance display drive, is outputted to all the scanning lines during a blanking period between a period in which one scanning line is kept selected and a period in which a next scanning line is kept selected.

Accordingly, the signal level of the scanning line drive signal during the blanking period is changed by controlling the display luminance in the display unit.

In accordance with the present embodiment, there is provided an effect that, in the case where high-luminance display drive and low-luminance display drive are switched, it is possible to realize high-quality display which maintains gradations even under a low-luminance display drive state.

BRIEF DESCRIPTION OF THE DRAWINGS

The objects and features of the present invention will become apparent from the following description of embodiments, given in conjunction with the accompanying drawings, in which:

FIGS. 7A and 7B are explanatory views of display luminance switching in accordance with the embodiment;

FIG. 8 is an explanatory view of a gradation setting table for switching display luminance in accordance with the embodiment.

DETAILED DESCRIPTION OF THE EMBODIMENTS

Hereinafter, an embodiment of the present invention will now be described in the following order.

1. Configuration of Display Apparatus according to an Embodiment
2. L Blanking Drive and H Blanking Drive
3. Switching of High-Luminance Display Drive and Low-Luminance Display Drive
4. Effects of the Embodiment and Modified Examples

1. Configuration of Display Apparatus According to an Embodiment

Figure 1:
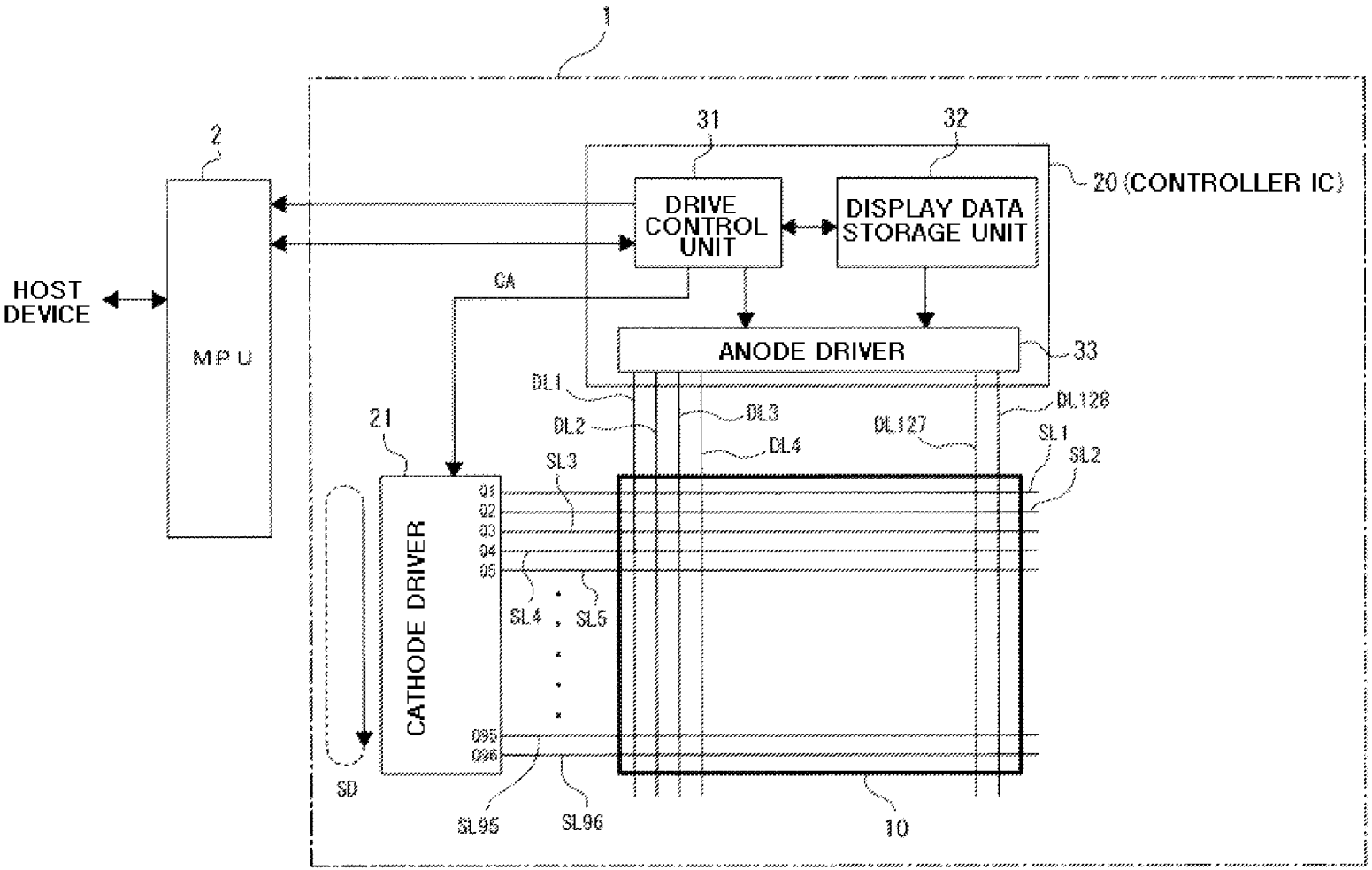
FIG. 1 is a block diagram of a display apparatus in accordance with an embodiment of the present invention.

FIG. 1 shows a display apparatus 1 according to an embodiment and an MPU (micro processing unit) 2 for controlling a display operation of the display apparatus 1.

The display apparatus 1 includes a display unit 10 which constitutes a display screen, a controller IC (integrated circuit) 20 and a cathode driver 21.

The display apparatus 1 having such a configuration corresponds to a display apparatus of the claims. The cathode driver 21 corresponds to a scanning line driving device (scanning line driving unit) of the claims.

In the example shown in FIG. 1, the cathode driver 21 is provided independently of the controller IC 20. Alternatively, the cathode driver 21 may be provided within the controller IC 20. In this case, the controller IC 20 corresponds to a scanning line driving device of the claims.

In the display unit 10, there are disposed data lines DL (DL1 to DL128) and scanning lines SL (SL1 to SL96). Pixels are arranged at the respective intersections of the data lines DL and the scanning lines SL. Specifically, in a corresponding relationship with the data lines DL1 to DL128 and the scanning lines SL1 to SL96, 128 pixels are disposed in each horizontal line (row) and 96 pixels are disposed in each vertical line (column).

Accordingly, the display unit 10 includes 12288 (128×96) pixels which constitute a displayed image. In the present embodiment, each pixel is formed of a self-luminous element which makes use of an OLED. Needless to say, the number of pixels, the number of data lines and the number of scanning lines are nothing more than one example.

Each of the 128 data lines DL1 to DL128 is connected to the 96 pixels arranged in the column direction (vertical direction) in the display unit 10. Each of the 96 scanning lines SL1 to SL96 is connected to the 128 pixels arranged in the row direction (horizontal direction).

A light-emission drive current based on display data (gradation values) is applied, as a data line drive signal, from the data lines DL to 128 pixels on a selected scanning line SL, whereby the 128 pixels are driven to emit light at the luminance (gradation) corresponding to the display data.

The controller IC 20 and the cathode driver 21 are provided for the purpose of display drive of the display unit 10.

The controller IC 20 includes a drive control unit 31, a display data storage unit 32 and an anode driver 33. The anode driver 33 drives the data lines DL1 to DL128.

Under the control of the drive control unit 31, the anode driver 33 supplies a constant current to the data lines DL for time periods corresponding to the gradations of the display data stored in the display data storage unit 32. That is to say, the anode driver 33 serves as a data line driving unit.

The drive control unit 31 performs communication of a command and display data with the MPU 2, thereby controlling a display operation pursuant to the command. For example, upon receiving a display start command, the drive control unit 31 sets a timing pursuant to the display start command and causes the cathode driver 21 to start scanning of the scanning lines SL. Furthermore, the drive control unit 31 causes the anode driver 33 to perform the driving of the data lines DL in synchronization with the scanning performed by the cathode driver 21.

As for the driving of the data lines DL performed by the anode driver 33, the drive control unit 31 stores in the display data storage unit 32 the display data received from the MPU 2 and transmits the display data to the anode driver in conformity with a scan timing. Moreover, the drive control unit 31 generates a constant current as a data line drive signal and supplies the constant current to the anode driver 33.

In response, the anode driver 33 outputs the constant current as a data line drive signal to the data lines DL for a time period corresponding to the respective gradations.

By virtue of this control, the respective pixels existing on the selected line, i.e., one scanning line SL to which a scanning line drive signal of a selected level is being applied from the cathode driver 21, are driven to emit light. The respective scanning lines are sequentially driven to emit light, whereby frame image display is realized.

The cathode driver 21 serves as a scanning line driving unit that applies a scanning line drive signal to one end of each scanning line SL.

Output terminals Q1 to Q96 of the cathode driver 21 are connected to the scanning lines SL1 to SL96, respectively. As indicated by a scanning direction SD, a scanning line drive signal of a selected level is outputted sequentially from the output terminals Q1 to Q96, so that scanning is performed so as to sequentially select the scanning lines SL1 to SL96.

In order to perform this scanning, the drive control unit 31 supplies cathode driver control signals CA to the cathode driver 21.

The cathode driver control signals CA comprehensively indicate various kinds of signals for the scanning control. In the present embodiment, the cathode driver control signals CA include a scan signal SK, a latch signal LAT, a clock signal CLKc, a blanking control signal BK and a blanking level signal LBK.

Figure 2:
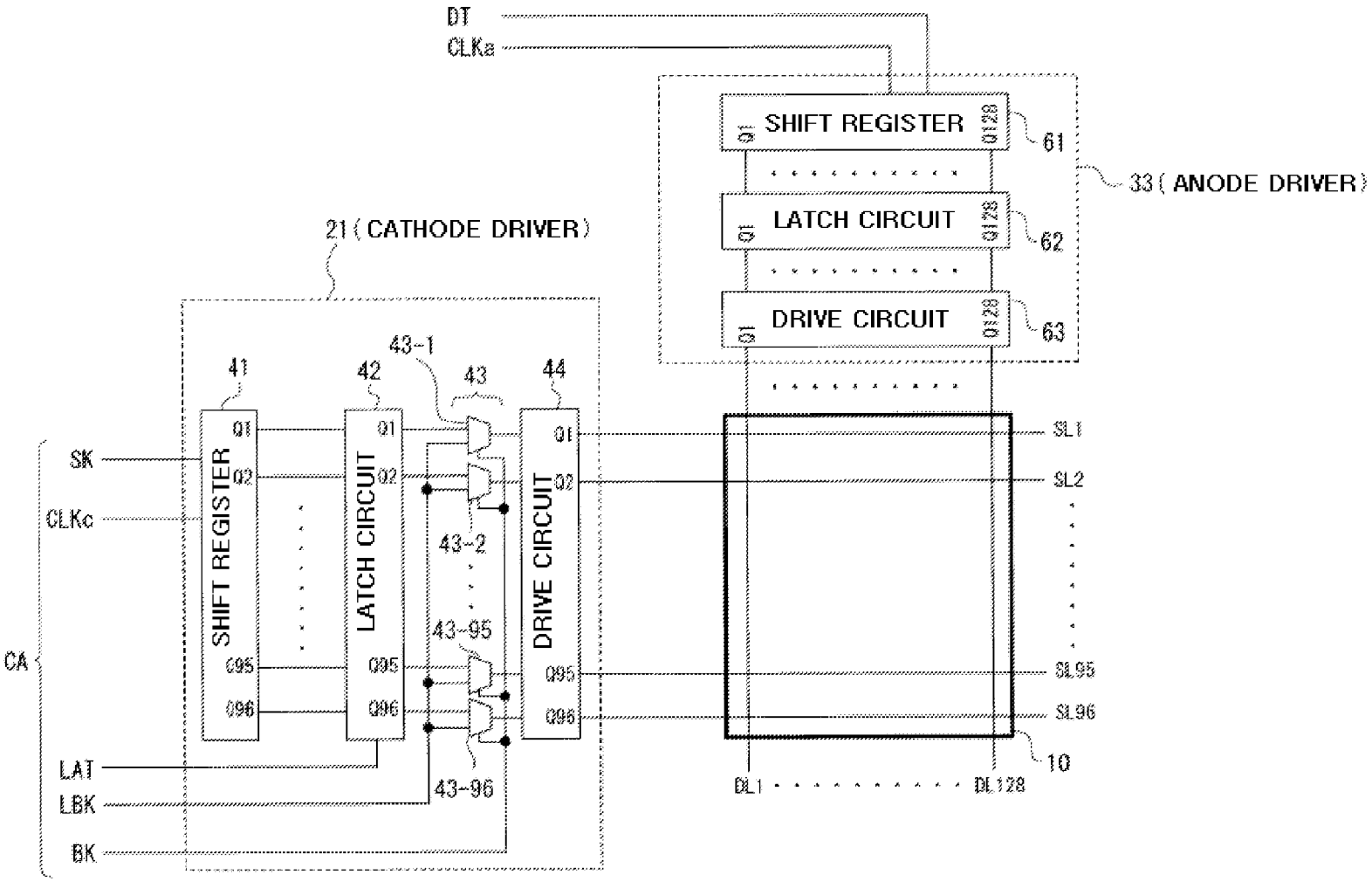
FIG. 2 is a block diagram of a cathode driver and an anode driver in accordance with the embodiment.

FIG. 2 shows, in detail, the cathode driver 21, the anode driver 33 and the display unit 10 which are shown in FIG. 1.

The anode driver 33 includes a shift register 61, a latch circuit 62 and a drive circuit 63. When performing display drive, a clock signal CLKa and a display data DT are supplied to the anode driver 33 from the drive control unit 31 of the controller IC 20 shown in FIG. 1.

The shift register 61 obtains outputs Q1 to Q128 corresponding to the data lines DL1 to DL128. The shift register 61 receives the display data DT using the clock signal CLKa, and sequentially sets the display data DT as the outputs Q1 to Q128. These outputs Q1 to Q128, i.e., the display data DT for one scanning line, are latched to the latch circuit 62, and transmitted to the drive circuit 63 as outputs Q1 to Q128 of the latch circuit 62.

The outputs Q1 to Q128 of the drive circuit 63 are connected to the data lines DL1 to DL128. The drive circuit 63 outputs a constant current to the data lines DL1 to DL128 for time periods corresponding to the gradation values of the respective pixels.

For example, the drive circuit 63 generates a control pulse having a pulse width corresponding to the gradation values defined by the outputs Q1 to Q128 of the latch circuit 62. A constant current output switch is controlled by the control pulse. Thus, a constant current is supplied to the respective data lines DL for time periods corresponding to the gradation values. The light emission gradation of each of the pixels is controlled depending on the current supply time.

The cathode driver 21 includes a shift register 41, a latch circuit 42, selectors 43 (43-1 to 43-96) and a drive circuit 44.

As mentioned above, the scan signal SK, the clock signal CLKc, the latch signal LAT, the blanking control signal BK and the blanking level signal LBK, which are the cathode driver control signals CA generated from the drive control unit 31 of the controller IC 20, are supplied to the cathode driver 21.

The scan signal SK is, e.g., a signal indicating the frame scan timing. The shift register 41 transmits a signal of a selected level based on the scan signal SK from each of the terminals Q1 to Q96, sequentially from the terminal Q1 to the terminal Q96, thereby obtaining outputs Q1 to Q96 respectively corresponding to the scanning lines SL1 to SL96.

The outputs Q1 to Q96 of the shift register 41 are latched by the latch circuit 42 at a timing pursuant to the latch signal LAT. The outputs Q1 to Q96 of the latch circuit 42 are supplied to the drive circuit 44 through the selectors 43 (43-1 to 43-96).

The outputs Q1 to Q96 of the drive circuit 44 correspond to the outputs of the terminals Q1 to Q96 shown in FIG. 1. That is to say, the outputs Q1 to Q96 of the drive circuit 44 are applied to the scanning lines SL1 to SL96 as the scanning line drive signal.

The blanking control signal BK is a signal which keeps all the scanning lines SL in a non-selected state in the scanning process of the respective scanning lines and which defines a timing at which the pixels are not driven to emit light. That is to say, the blanking control signal BK defines a blanking period between a period in which one scanning line SL is kept selected and a period in which another scanning line SL is kept selected.

The blanking level signal LBK is a level signal (a high level (H level) signal or a low level (L level) signal) applied to the scanning lines SL during the blanking period. The blanking level signal LBK is inputted to the selectors (43-1 to 43-96) and either one of the blanking level signal LBK and the outputs Q1 to Q96 of the latch circuit 42, which is also inputted to the selectors, is selected. The selections of the selectors 43 (43-1 to 43-96) are controlled by the blanking control signal BK.

Figures 3A, 3B:
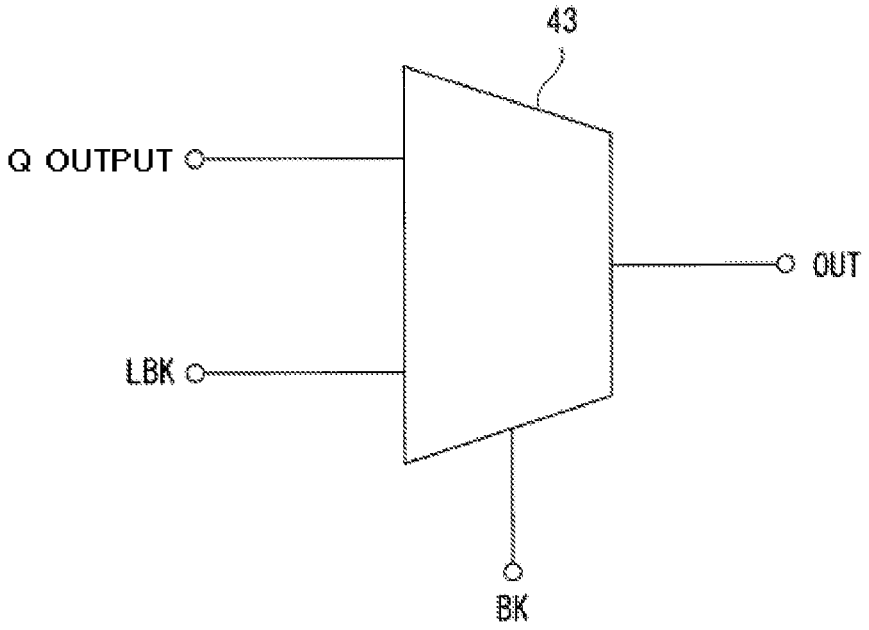
FIGS. 3A and 3B are explanatory views of a selector in a cathode driver in accordance with the embodiment.

FIG. 3A shows an enlarged view of the selector 43. As shown in FIG. 3A, the output Q of the latch circuit 42 and the blanking level signal LBK are inputted to the selector 43. The blanking control signal BK as a control signal is also inputted to the selector 43.

The control logic of the selector 43 is shown in FIG. 3B. For example, if the blanking control signal BK is at an L level (0), the output Q of the latch circuit 42 is selected as the output OUT of the selector 43. If the blanking control signal BK is at an H level (1), the blanking level signal LBK is selected as the output OUT of the selector 43.

2. L Blanking Drive and H Blanking Drive

In the present embodiment configured as above, L blanking drive and H blanking drive can be switched as a driving method for the scanning lines SL. Description will now be made on the L blanking drive and the H blanking drive.

Figure 4A:
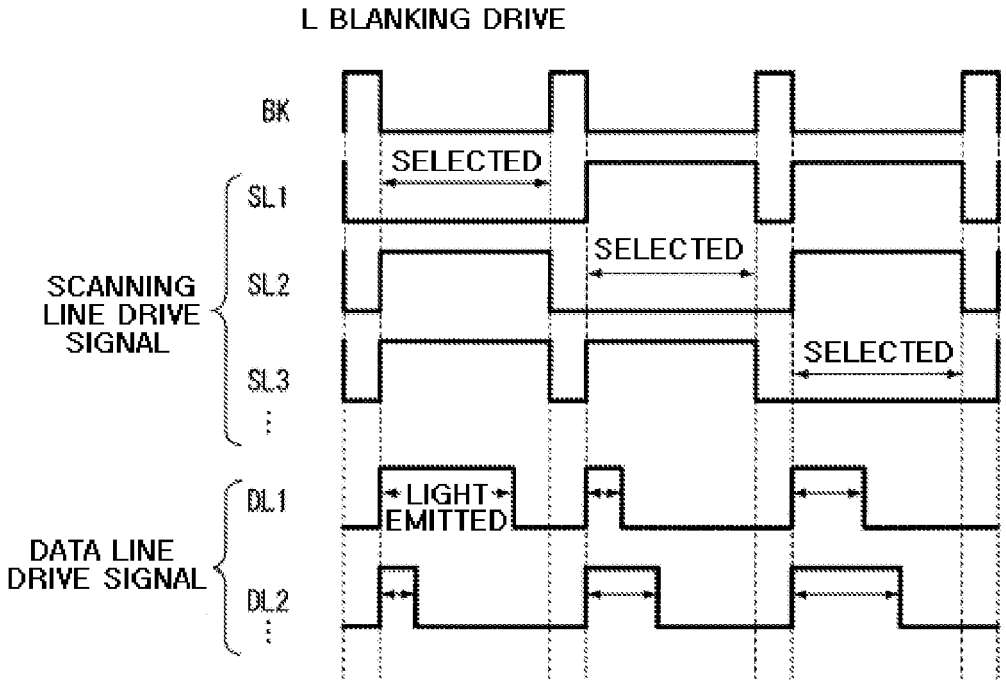
FIGS. 4A and 4B are explanatory views of L blanking drive and H blanking drive.
Figure 4B:
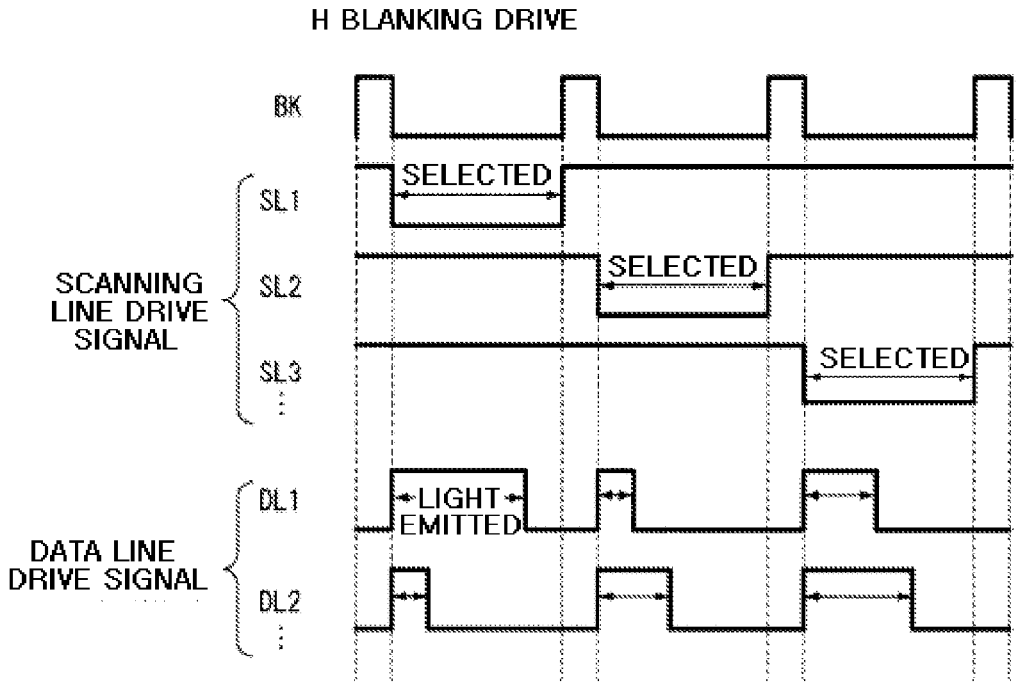

FIGS. 4A and 4B show a waveform of the L blanking drive and a waveform of the H blanking drive, respectively. In FIGS. 4A and 4B, there are shown a blanking control signal BK, scanning line drive signals and data line drive signals. As for the scanning line drive signals, there are illustrated scanning line drive signals applied to the scanning lines SL1, SL2 and SL3. As for the data line drive signals, there are illustrated data line drive signals applied to the data lines DL1 and DL2.

By virtue of the scanning line drive signals, the respective scanning lines SL1, SL2, etc. are sequentially selected. The respective scanning lines SL are selected by applying an L level as the scanning line drive signals.

In this case, a constant current is supplied, as the data line drive signals, to the data lines DL for time periods corresponding to the gradations of the respective pixels existing on the selected scanning line SL. The pulse waveform shown in FIGS. 4A and 4B is the output terminal voltage of the anode driver 33. The pulse waveform indicates the constant current supply period. The H level pulse period is the light emission period of each of the pixels. The gradation is expressed by the length of the H level pulse period.

In this regard, the period during which the blanking control signal BK is kept at an H level is the blanking period. Light emission is not performed during the blanking period. That is to say, the constant current as the data line drive signals is not supplied during the blanking period.

In the case of the L blanking drive, the scanning line drive signals for all the scanning lines SL are kept at an L level during the blanking period.

In the case of the H blanking drive, the scanning line drive signals for all the scanning lines SL are kept at an H level during the blanking period.

In the present embodiment, the blanking level signal LBK described with reference to FIG. 2 serves as a signal for obtaining an L level of the scanning line drive signal in the L blanking drive and an H level of the scanning line drive signal in the H blanking drive. Specifically, when the blanking level signal LBK is L level and the blanking level signal LBK is selected in the selector 43 during the blanking period, the scanning line drive signals have the waveforms indicated in the L blanking drive in FIG. 4A. When the blanking level signal LBK is H level and the blanking level signal LBK is selected in the selector 43 during the blanking period, the scanning line drive signals have the waveforms indicated in the H blanking drive in FIG. 4B.

Merits and demerits of the L blanking drive and the H blanking drive will now be described.

In the L blanking drive, the rise of the data line drive signals is fast and the constant current supply time and the linearity of the light emission gradation are suitable. Further, the power consumption is reduced. However, if the time width in the gradation range is shortened to a certain value or less, gradation collapse occurs.

In the H blanking drive, the rise of the data line drive signals is slow. However, in the case of low-luminance display, driving can be performed with no occurrence of gradation collapse.

First, the rise of the data line drive signals and the power consumption will be described with reference to FIGS. 5A to 5C.

Figure 5A:
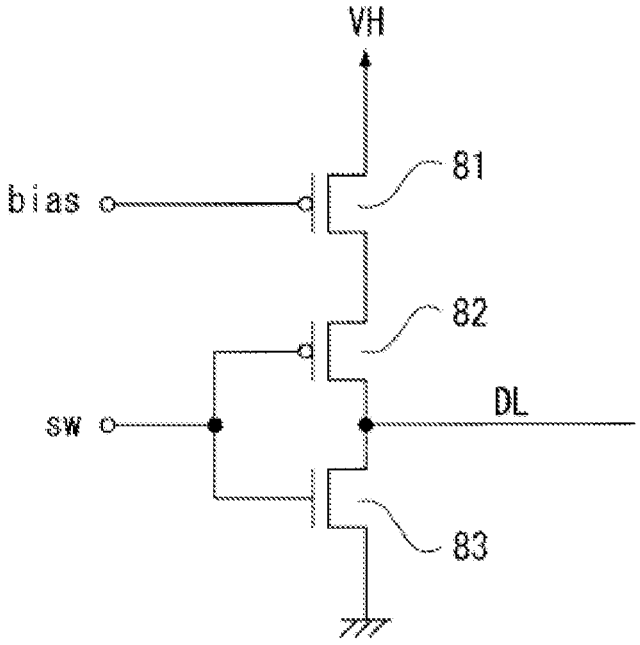
FIGS. 5A to 5C are explanatory views of the rise and the loss of L blanking drive and H blanking drive.

FIG. 5A shows a configuration example of an output terminal of the anode driver 33 (the drive circuit 63) corresponding to one data line DL. P-channel FETs (Field Effect Transistors) 81 and 82 and an N-channel FET 83 are serially connected to one another. A voltage VH is applied to a source of the FET 81. A drain of the FET 81 is connected to a source of the FET 82. A drain of the FET 82 and a drain of the FET 83 are connected to each other. A source of the FET 83 is grounded. A connection point of the FETs 82 and 83 is connected to the data line DL. This output terminal configuration is provided for each of the data lines DL1 to DL128.

In this case, a bias voltage is applied to a gate of the FET 81 and a constant current flows across the source and drain of the FET 81.

The FETs 82 and 83 are turned on and off by a signal SW. The signal SW is a control signal for allowing a constant current to be outputted for a time period corresponding to the gradation of a pixel indicated by the display data and is a pulse signal whose time period is set in conformity with the display data (data of the respective pixels).

If the FET 82 is turned on and the FET 83 is turned off by the signal SW, the drain current of the FET 82 is supplied to the data line DL.

If the FET 82 is turned off and the FET 83 is turned on by the signal SW, the data line DL is grounded.

Accordingly, the signal SW is generated based on the display data and the FETs 82 and 83 are controlled by the signal SW, whereby a constant current is outputted to the data line DL for a time period corresponding to the gradation value indicated by the display data.

Description will now be made on the rise of the data line drive signals applied to the data lines DL and the rise of the resultant light emission luminance.

In a passively-driven OLED display device, in order to improve the rise of the light emission luminance, it is important to quickly charge the parasitic capacitance of an EL (Electroluminescence) element.

In the case of the L blanking drive, the parasitic capacitance of all the EL elements is discharged (reset) by setting all the scanning lines SL to an L level during the blanking period. Thereafter, non-selected scanning lines SL are set to an H level and a reverse bias voltage is applied to the EL elements on the non-selected lines. Thus, the current for charging the parasitic capacitance of the EL elements which are emitting light is supplied not only from the anode side (the data lines DL) but also from the non-selected scanning lines SL, thereby ensuring that the charging of the parasitic capacitance of the EL elements which are emitting light is quickly performed. Thus, the rise of the light emission luminance can be made fast. In other words, if the L blanking drive is not used, the current for charging the parasitic capacitance of the EL elements which are emitting light is supplied only from the data line DL. Accordingly, the charging is time-consuming and the rise of the light emission luminance becomes slow.

Figure 5B:
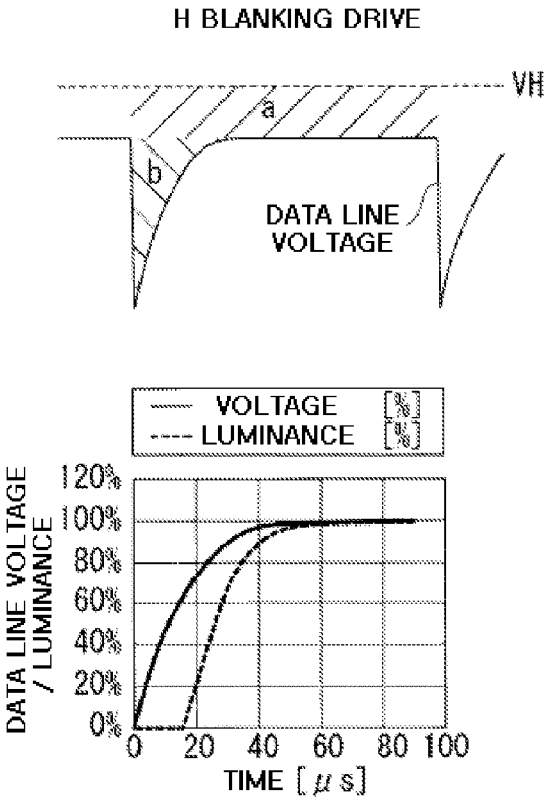
Figure 5C:
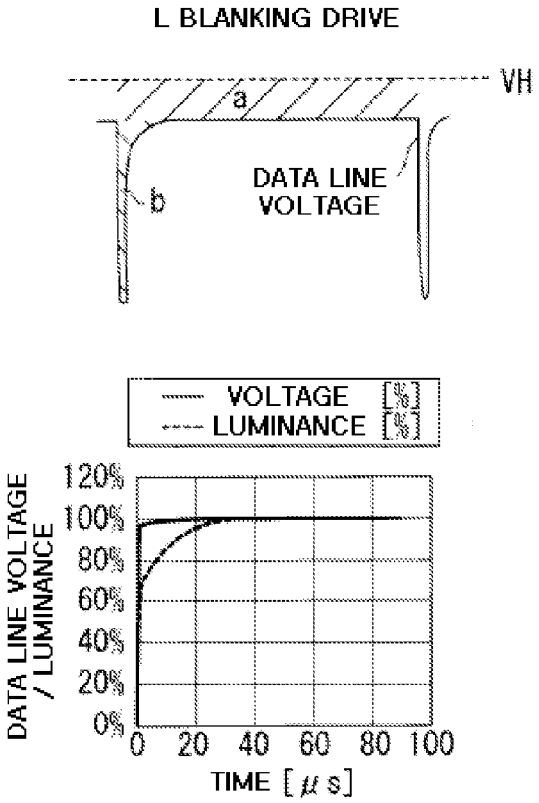

FIGS. 5B and 5C show the waveforms and the rising patterns of a data line voltage in the H blanking drive and in the L blanking drive, respectively. In upper diagrams in FIGS. 5B and 5C, there are shown a voltage VH inputted to the output terminal of the anode driver 33 and a voltage outputted to the data line DL. In lower diagrams in FIGS. 5B and 5C, the horizontal axis indicates the time and the vertical axis indicates the data line voltage and the luminance. The solid line indicates the data line voltage and the broken line indicates the luminance.

As shown in FIGS. 5B and 5C, for the reasons mentioned above, the rise of the data line voltage and the luminance is improved in the L blanking drive as compared with the H blanking drive.

Since the rise of the data line voltage and the luminance is improved in the L blanking drive, it is possible to reduce power consumption. In upper diagrams in FIGS. 5B and 5C, there are shown hatching portions "a" and "b" which indicate the loss of FETs 81 and 82 shown in FIG. 5A. In the case of the L blanking drive, the loss corresponding to the area of the hatching portions "a" and "b" is reduced compared to the case of the H blanking drive. This provides an advantage in that the heat generation is suppressed.

Next, dimming and gradation expression will be described with reference to FIG. 6.

For example, in a vehicle-mounted display apparatus which is mounted to a front panel of a motor vehicle, it is required that the luminance level (the brightness of a screen as a whole) be reduced to about 3% by dimming. Assuming that the normal luminance is, e.g., 200 candela, the luminance level is reduced to 6 candela by dimming.

Figure 6:
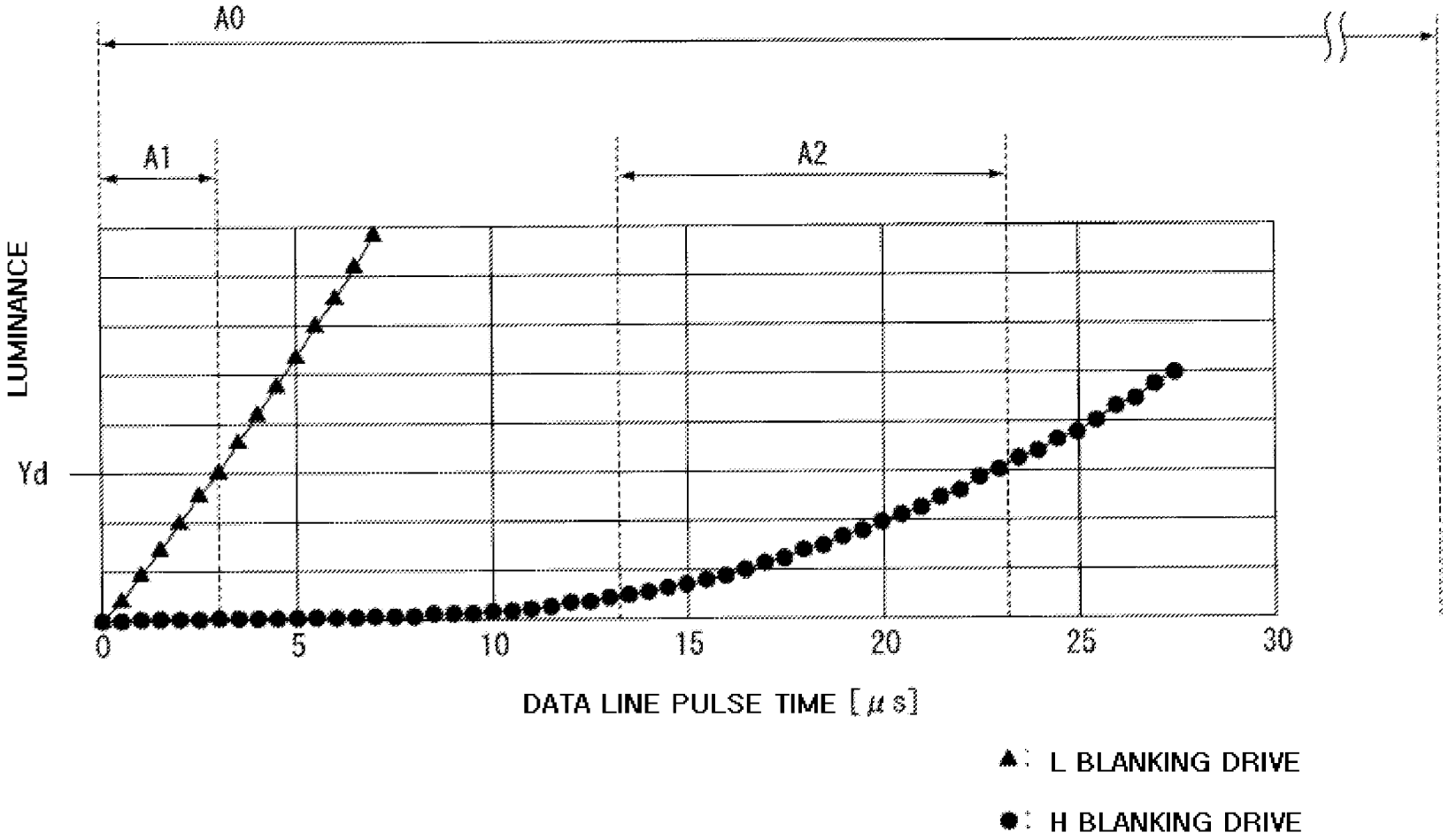
FIG. 6 is an explanatory view of gradation collapse caused by L blanking during low-luminance display drive.

In this regard, FIG. 6 shows the relationship between the data line pulse time (the application time of a constant current to the data line DL) and the luminance in the L blanking drive and the H blanking drive. Symbols ▲ and ● indicates the setting points of the data line pulse time which can be set depending on the resolving power of the anode driver 33.

As described above, the rise of the luminance is faster in the L blanking drive than in the H blanking drive.

In the case where 16 gradations (gradations of 0/15 to 15/15) are expressed at the normal luminance in the L blanking drive, the data line pulse time is set to fall within, e.g., a range A0. Luminance of 16 gradations can be expressed by setting the data line pulse time of each of the gradations to become equal to or greater than the resolving power indicated by the symbol ▲. The gradation of 0/15 is not indicated (The data line pulse time is equal to 0). Therefore, if at least 15 stages of data line pulse time can be variably set within the setting range of the data line pulse time, the expression of 16 gradations is maintained. Accordingly, as shown in FIG. 7A which will be later described, the gradation expression can be realized by setting the data line pulse time corresponding to each of the gradation values.

It is assumed that, in the dimming, the luminance needs to be reduced to luminance Yd shown in FIG. 6. In this case, the setting range of the data line pulse time has to be made equal to a range A1. Then, in the resolving power indicated by the symbol ▲, the gradations of 1/15 to 5/15 can be expressed, but the data line pulse time of the gradations of 6/15 to 15/15 needs to be the same. Therefore, gradation collapse occurs.

In reality, if the data line pulse time becomes 2.5 μs or less, it is almost impossible to visually express the gradations.

In the case of the H blanking drive, the rise of the luminance is slow. Therefore, even if the data line pulse time is made longer, the gradation expression can be performed at the luminance level required in the dimming. That is to say, the data line pulse time is set to fall within a range A2 under the assumption that the H blanking drive is performed. Thus, even if the luminance level is reduced to luminance Yd, the gradations of 1/15 to 15/15 can be expressed at the same resolving power indicated by a symbol ●.

As set forth above, the H blanking drive provides an advantage in that the gradations can be maintained even under a reduced luminance level.

Thus, in the present embodiment, during the high-luminance display drive (during the display drive at the normal luminance or during the dimming with a low luminance decrement), the L blanking drive is performed to keep all the scanning lines at an L level in the blanking period. During the low-luminance drive (during the dimming with a high luminance decrement), in order to maintain the gradation expression, the H blanking drive is performed to keep all the scanning lines at an H level in the blanking period.

3. Switching of High-Luminance Display Drive and Low-Luminance Display Drive Description will now be made on the detailed operations of switching between the H blanking drive and the L blanking drive.

The change of the luminance level is an increase or a decrease in the brightness of the entire display. Therefore, the change of the luminance level is performed by changing the range of the supply time of a constant current to the data lines DL (i.e., the data line pulse time shown in FIG. 6).

It is assumed that the luminance level of 100 is the normal luminance and the luminance level is reduced from the normal luminance during the dimming. FIG. 7A shows the pulse width corresponding to the data line pulse time when the luminance levels are 100 and 60. Since the data line pulse time, i.e., the constant current supply time, is controlled by the signal SW shown in FIG. 5A, the pulse width referred to herein may be regarded as the pulse width of the signal SW.

First, under the L blanking drive, when the luminance level is 100, the gradations of 1/15 to 15/15 are expressed by the pulse width of 3.5 μs to 145 μs.

In contrast, when the luminance level is 60, the gradations of 1/15 to 15/15 are expressed by the pulse width of 2.5 μs to 78.5 μs.

The setting of the pulse width in the luminance level of 60 does not generate gradation collapse even in the L blanking drive, when considering the resolving power shown in FIG. 6 and the shortest pulse time.

However, if the luminance level is further decreased, gradation collapse occurs in the L blanking drive. Thus, the L blanking drive is switched to the H blanking drive at a certain luminance level.

Figure 7B:
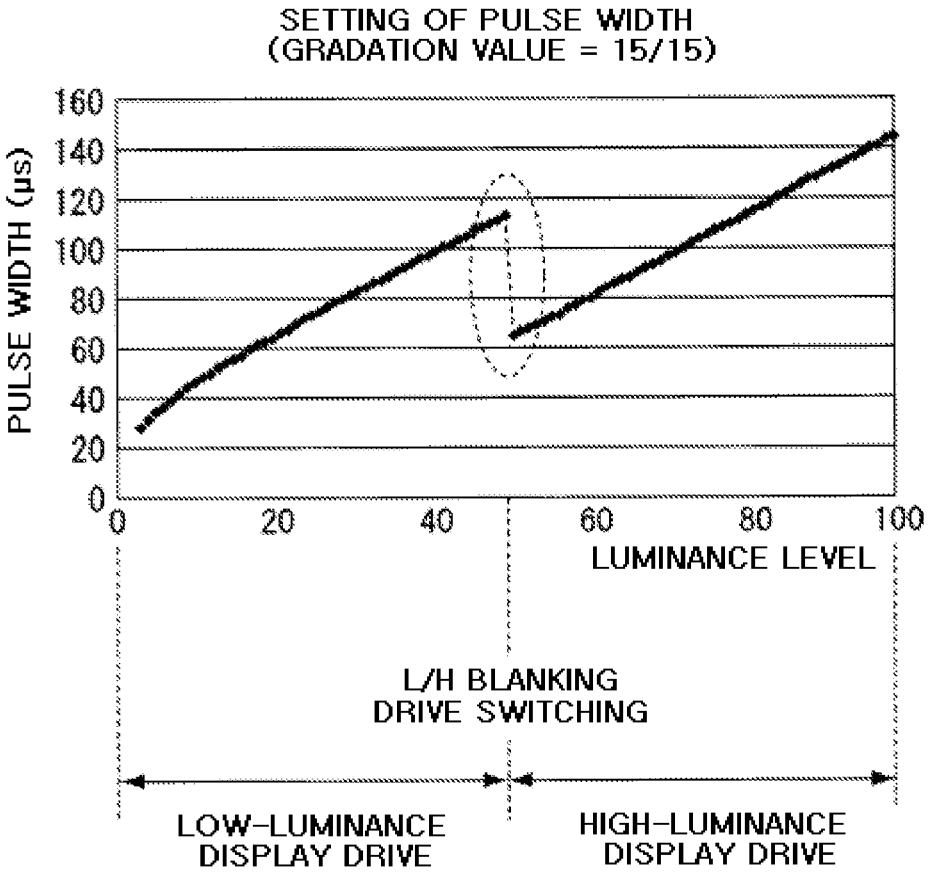

One example of the switching operation is shown in FIG. 7B. For example, the display drive at the luminance level of 100 to 50 is the high-luminance display drive. In this luminance level range, the L blanking drive is performed. The display drive at the luminance level of 49 or less is the low-luminance display drive, and in this case, the H blanking drive is performed.

In FIG. 7B, there is shown the pulse width of the gradation of 15/15.

FIG. 8 shows an example of setting specific pulse widths. In FIG. 8, there is shown an example where the luminance levels are 100, 50, 49 and 3.

When the luminance levels are 100 and 50, the pulse width are set under the assumption that the L blanking drive is performed. When the luminance levels are 49 and 3, the pulse width are set under the assumption that the H blanking drive is performed.

The setting of the pulse width at the luminance level of 100 is the same as that shown in FIG. 7A.

At the luminance level of 50, the gradations of 1/15 to 15/15 are expressed by the pulse width of 2.5 μs to 65 μs.

The pulse width of 2.5 μs is the minimum value of the pulse width capable of visually expressing the gradation. Since it is not advisable to make the pulse width shorter than 2.5 μs, the H blanking drive is performed at the luminance level of 49 or less.

At the luminance level of 49, the gradations of 1/15 to 15/15 are expressed by the pulse width of 11 μs to 113 μs.

At the luminance level of 3, the gradations of 1/15 to 15/15 are expressed by the pulse width of 6.5 μs to 28 μs.

As such, by using the H blanking drive, the pulse width of the 1/15 gradation can be set to 6.5 μs even when the luminance level is 3 which is a very low value. This makes it possible to sufficiently perform the gradation expression.

The specific operations for switching L blanking drive and the H blanking drive will now be described.

The MPU 2 notifies the luminance levels of 100 to 3 to the controller IC 20. For example, the MPU 2 sets the luminance level based on detected brightness information or an instruction sent from a host device (an ECU (Electronic Control Unit) in the case of a motor vehicle) and notifies the luminance level to the controller IC 20 in response to a display luminance switching command.

As the display luminance switching command, the MPU 2 may deliver a gradation setting table to the controller IC 20.

The gradation setting table is the table data shown in FIGS. 7A and 8, namely the setting table of the pulse widths of the respective gradations.

Upon receiving the gradation setting table, the controller IC 20 decides the data line output pulse of the anode driver 33, thereby realizing the display at the notified luminance level.

In the present embodiment, as the display luminance switching command, the MPU 2 delivers not only the gradation setting table but also the information designating the H blanking drive or the L blanking drive to the controller IC 20.

Figure 9:
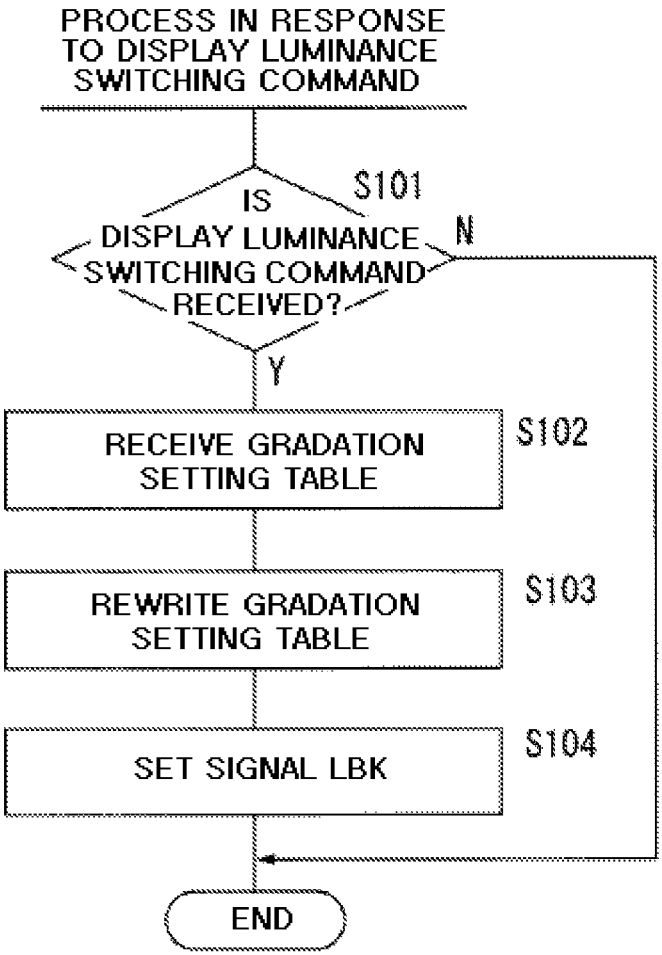
FIG. 9 is a flowchart showing a process in response to a display luminance switching command in accordance with the embodiment.

FIG. 9 shows the process implemented by the controller IC 20 (the drive control unit 31) in response to the display luminance switching command delivered from the MPU 2.

In step S101, the drive control unit 31 monitors the display luminance switching command. If the display luminance switching command is received, the flow proceeds to step S102 where the drive control unit 31 receives the gradation setting table.

Then, in step S103, the drive control unit 31 rewrites the gradation setting table to the anode driver 33. As mentioned above, the anode driver 33 outputs a constant current to the data lines DL during the periods of the pulse widths corresponding to the display data (gradation values). Herein, the anode driver 33 changes the pulse widths corresponding to the respective gradation values. Therefore, the luminance level is changed.

Further, the information designating the H blanking drive or the L blanking drive is included in the display luminance switching command. Thus, in step S104, the drive control unit 31 checks the information and sets a blanking level signal LBK to be supplied to the cathode driver 21.

For example, if the display luminance has one of the luminance levels of 100 to 50, the L blanking drive is instructed. In this case, the drive control unit 31 supplies the blanking level signal LBK of an L level to the cathode driver 21.

If the display luminance has a luminance level of 49 or less, the H blanking drive is instructed. In this case, the drive control unit 31 supplies the blanking level signal LBK of an H level to the cathode driver 21.

Alternatively, the information designating the H blanking drive or the L blanking drive may not be included in the display luminance switching command delivered from the MPU 2.

For example, if a designated gradation setting table belongs to one of the luminance levels of 100 to 50, the drive control unit 31 may set the blanking level signal LBK to an L level in step S104 to perform the L blanking drive. If a designated gradation setting table belongs to the luminance level of 49 or less, the drive control unit 31 may set the blanking level signal LBK to an H level in step S104 to perform the H blanking drive. That is to say, the determination of the switching of the H blanking drive and the L blanking drive may be performed by the controller IC 20 rather than the MPU 2.

When the luminance level is changed by implementing the process shown in FIG. 9, the H level and the L level of the blanking level signal LBK are changed in conformity with the changed luminance level. Then, the blanking level signal LBK is supplied to the cathode driver 21. Thus, in the cathode driver 21, the H level and the L level of the blanking level signal LBK during the blanking period are set depending on the luminance level. Specifically, the L blanking drive is performed in the high-luminance display drive and the H blanking drive is performed in the low-luminance display drive.

4. Effects of the Embodiment and Modified Examples

The following effects are obtained by the present embodiment described above.

In the present embodiment, the display unit 10 includes data lines DL each connected to a plurality of pixels arranged in a column direction and scanning lines SL each connected to a plurality of pixels arranged in a row direction. The pixels are arranged at intersections of the data lines DL and the scanning lines SL. The cathode driver 21 (the scanning line driving unit) for driving the scanning lines SL of the display unit 10 keeps each of the scanning lines SL1 to SL96 in a selected state pursuant to a predetermined order. The cathode driver 21 outputs a scanning line drive signal, which becomes an L level in the high-luminance display drive and an H level in the low-luminance display drive, to all the scanning lines SL1 to SL96, during a blanking period between a period in which one scanning line SL is kept selected and a period in which another scanning line SL is kept selected.

In the case of the high-luminance display drive, the L blanking drive is performed. As a result, the rise of the data line drive signal (the rise of the light emission luminance) is improved. This helps reduce the power consumption and suppress the temperature increase. Moreover, the luminance gradation having the high linearity with respect to the data line pulse width is realized. This makes it possible to perform display at high gradation accuracy.

On the other hand, in the case of the low-luminance display drive, there is sometimes the case that gradation collapse occurs in the L blanking drive. However, in the present embodiment, the L blanking drive is switched to the H blanking drive. Thus, the gradation can be maintained even when low-luminance display is performed by dimming. This makes it possible to realize high-quality display.

The rise of the data line drive signal becomes dull due to the H blanking drive. However, this is limited to the low-luminance display drive. Since the drive is performed with a relatively short data line pulse width, the power loss and the resultant heat generation almost do not matter.

As a result, in the present embodiment, high-quality display can be realized regardless of the normal display and the dimming display.

In order to switch the L blanking drive and the H blanking drive, the cathode driver 21 includes: the signal generating unit (the shift register 41 and the latch circuit 42) for generating signals indicating whether the respective scanning lines SL are in a selected state or in a non-selected state; the selectors 43 (43-1 to 43-96) provided to respectively correspond to the scanning lines SL; and the output unit (the drive circuit 44) for outputting voltage signals, which correspond to the outputs of the respective selectors 43-1 to 43-96, as the scanning line drive signal for the respective scanning lines SL. A signal sent from the signal generating unit (the shift register 41 and the latch circuit 42) for the corresponding scanning line SL and the blanking level signal LBK of a high level or a low level to be outputted to the scanning line SL during the blanking period are inputted to each of the selectors 43. In each of the selectors 43, either one of the signal sent from the signal generating unit and the blanking level signal LBK is selected based on the blanking control signal BK which defines the blanking period. Specifically, during the non-blanking period, the signal sent from the signal generating unit (the shift register 41 and the latch circuit 42) is selected and outputted. During the blanking period, the blanking level signal LBK is selected and outputted.

The blanking level signal LBK thus inputted is set by the controller IC 20 (the drive control unit 31) to a low level in the high-luminance display drive and to a high level in the low-luminance display drive.

According to this configuration, it is possible to easily realize the output of the scanning line drive signal which drives all the scanning lines SL by the L blanking drive in the high-luminance display drive and drives all the scanning lines SL by the H blanking drive in the low-luminance display drive during the blanking period. That is to say, if a configuration capable of selecting the blanking level signal LBK during the blanking period is provided in the cathode driver 21, it is possible to realize a configuration capable of switching the H blanking drive and the L blanking drive.

The controller IC 20 includes the drive control unit that receives a display luminance switching command as the instruction information on the display operation from the outside (MPU 2). Upon receiving, as the instruction information, the blanking level designation information and a gradation setting table corresponding to the display luminance, the drive control unit 31 controls the data line drive signal of the anode driver 33 (the data line driving unit) to be generated based on the gradation setting table. Further, the drive control unit 31 supplies the blanking level signal LBK of a high level or a low level corresponding to the blanking level designation information to the cathode driver 21 (the scanning line driving unit).

By doing so, the switching between the luminance levels and the switching between the H blanking drive and the L blanking drive can be realized by an external command. This makes it possible to realize suitable dimming control in conformity with the actual use condition of the display apparatus.

While an embodiment has been described above, the scanning line driving device, the display apparatus and the scanning line driving method of the present invention are not limited to the embodiment but may be modified in many different forms.

The range of the luminance level for performing the L blanking drive in the high-luminance display drive and the range of the luminance level for performing the H blanking drive in the low-luminance display drive can be variously set. In reality, these ranges may be suitably decided depending on the setting of pulse width of the each gradation.

The switching of the luminance levels may be performed at two stages or more.

For example, the two-stage switching refers to the switching between the normal luminance display and the dimming. In this case, the L blanking drive is performed in the normal luminance display and the H blanking drive is performed in the dimming.

In the case where the luminance levels are switched at three stages or more, the switching points of the H blanking drive and the L blanking drive may be decided, depending on the setting of the gradation number and the shortest pulse width at the respective luminance levels, so that the gradation expression can be maintained.

The gradation setting table described with reference to FIGS. 7A and 8 is stored in the MPU 2 in the process shown in FIG. 9 and is transmitted to the controller IC 20 at the time of switching the display luminance. However, the gradation setting table may be stored within the controller IC 20. In this case, the MPU 2 may designate only the luminance level in response to the display luminance switching command, and the controller IC 20 may select the gradation setting table corresponding to the designated luminance level and set the selected gradation setting table in the anode driver 33.

The present invention can be applied to not only the display apparatus which makes use of an OLED but also other display apparatuses. Particularly, the present invention is suitable for a display apparatus which makes use of a self-luminous element driven by a current.

In addition, the present invention can be applied to not only the vehicle-mounted display apparatus but also many other display apparatuses configured to change a display luminance.

While the invention has been shown and described with respect to the embodiments, it will be understood by those skilled in the art that various changes and modifications may be made without departing from the scope of the invention as defined in the following claims.

What is claimed is:

1. A scanning line driving device for driving scanning lines in a display unit which includes data lines each connected to a plurality of pixels arranged in a column direction and the scanning lines each connected to a plurality of pixels arranged in a row direction, the pixels arranged at respective intersections of the data lines and the scanning lines, wherein the scanning line driving device is configured to sequentially keep each of the scanning lines in a selected state pursuant to a predetermined order and output a scanning line drive signal, wherein all the scanning lines are set to a low level in a high-luminance display drive in which a brightness of the display unit is higher than a predetermined brightness of the display unit larger than zero and to a high level in a low-luminance display drive in which the brightness of the display unit is equal to or lower than the predetermined brightness, during a blanking period.

2. The scanning line driving device of claim 1, comprising:

a signal generating unit configured to generate a signal for each of the scanning lines, the signal indicating whether a corresponding scanning line among the scanning lines is in a selected state or in a non-selected state;

a plurality of selectors provided to respectively correspond to the scanning lines, wherein each of the selectors receives the signal sent from the signal generating unit for the corresponding scanning line and a blanking level signal of a high level or a low level, and outputs, based on a blanking control signal which defines the blanking period, the signal sent from the signal generating unit during a non-blanking period and the blanking level signal during the blanking period; and an output unit configured to output, as the scanning line drive signal for each of the scanning lines, a voltage signal corresponding to an output of each of the selectors, wherein the blanking level signal inputted to each of the selectors is set to a low level in the high-luminance display drive and to a high level in the low-luminance display drive.

3. The scanning line driving device of claim 1, wherein a rise of the brightness of the display unit is faster in the high-luminance display drive than in the low-luminance display drive.

4. A display apparatus, comprising:

a display unit including data lines each connected to a plurality of pixels arranged in a column direction and scanning lines each connected to a plurality of pixels arranged in a row direction, the pixels arranged at respective intersections of the data lines and the scanning lines;

a scanning line driving unit configured to apply a scanning line drive signal to each of the scanning lines; and a data line driving unit configured to apply a data line drive signal to each of the data lines, the data line drive signal corresponding to a gradation value of each of the pixels defined by display data, wherein the scanning line driving unit is configured to sequentially keep each of the scanning lines in a selected state pursuant to a predetermined order and output a scanning line drive signal, wherein all the scanning lines are set to a low level in a high-luminance display drive in which a brightness of the display unit is higher than a predetermined brightness of the display unit larger than zero and to a high level in a low-luminance display drive in which the brightness of the display unit is equal to or lower than the predetermined brightness, during a blanking period.

5. The display apparatus of claim 4, further comprising:

a drive control unit configured to receive instruction information on a display operation from the outside, and wherein when receiving, as the instruction information, blanking level designation information and a gradation setting table corresponding to a display luminance, the drive control unit controls the data line drive signal of the data line driving unit to be generated based on the gradation setting table, and supplies, to the scanning line driving unit, a blanking level signal of a high level or a low level corresponding to the blanking level designation information, and wherein the scanning line driving unit outputs, as the scanning line drive signal for each of the scanning lines, a voltage signal corresponding to the blanking level signal, during the blanking period.

6. The display apparatus of claim 4, wherein a rise of the brightness of the display unit is faster in the high-luminance display drive than in the low-luminance display drive.

7. A scanning line driving method for driving scanning lines in a display unit which includes data lines each connected to a plurality of pixels arranged in a column direction and the scanning lines each connected to a plurality of pixels arranged in a row direction, the pixels arranged at respective intersections of the data lines and the scanning lines, wherein each of the scanning lines is sequentially kept in a selected state pursuant to a predetermined order, and a scanning line drive signal, wherein all the scanning lines are set to a low level in a high-luminance display drive in which a brightness of the display unit is higher than a predetermined brightness of the display unit larger than zero and to a high level in a low-luminance display drive in which the brightness of the display unit is equal to or lower than the predetermined brightness, during a blanking period.

8. The scanning line driving method of claim 7, wherein a rise of the brightness of the display unit is faster in the high-luminance display drive than in the low-luminance display drive.

* * * * *